US006360402B1

(12) United States Patent
Crabtree

(10) Patent No.: US 6,360,402 B1
(45) Date of Patent: Mar. 26, 2002

(54) TRAVEL CASE PULL HANDLE

(76) Inventor: Amy Marie Crabtree, 124A Clinton Park, San Francisco, CA (US) 94103

( * ) Notice: Subject to any disclaimer, the term of this patent is extended or adjusted under 35 U.S.C. 154(b) by 0 days.

(21) Appl. No.: 09/517,321

(22) Filed: Mar. 2, 2000

(51) Int. Cl.[7] ..... A45C 13/22

(52) U.S. Cl. ..... 16/430; 16/431; 16/422; 403/322.3

(58) Field of Search ..... 16/422, 430, 431, 16/DIG. 12, DIG. 19; 403/322.3, 76, 122, 164, 165

(56) References Cited

U.S. PATENT DOCUMENTS 2,274,605 A * 2/1942 Hoffmeister ..... 16/DIG. 12
4,023,803 A * 5/1977 Lewis ..... 16/430
5,299,497 A * 4/1994 Dias ..... 16/430
5,715,571 A * 2/1998 Fasano ..... 16/DIG. 12
5,867,868 A * 2/1999 Ward ..... 16/422
5,898,975 A * 5/1999 Hancock ..... 16/DIG. 12
6,161,451 A * 12/2000 Gleason, II ..... 403/122

FOREIGN PATENT DOCUMENTS

GB 2113081 A * 8/1983 ..... 16/422

* cited by examiner

*Primary Examiner*—Lynne H. Browne
*Assistant Examiner*—Aaron Dunwoody
(74) *Attorney, Agent, or Firm*—Glasgow Law Firm

(57) ABSTRACT

Travel case pull handle having: a pair of C shaped tubular members connected on one longitudinal side by a hinge member, a centrally located bearing capable of retaining and L shaped arm, the arm terminating in a ball joint, the ball joint fitted into a ball socket, the ball socket connected to a handle, the handle being ergonomically shaped to fit a users gripped hand and having a downwardly extending portion which cradles the users fore finger and thumb, said C shaped tubular members having hook type fastener material on one outer surface and a pair of fabric loop fastener strips extending from said opposite C shaped tubular member, and the inside of said C shaped tubular members each having resilient compressible, longitudinally running strips.

9 Claims, 4 Drawing Sheets

TRAVEL CASE PULL HANDLE

BACKGROUND OF THE INVENTION

This invention relates generally to the field of carry handles, and more particularly to a travel case pull handle.

Travel cases of various designs, used by people for the containment and transport of articles such as clothing and the like, have been in existence for hundreds of years. Recently a category of travel cases has appeared that includes a pull out handle and a set of wheels, thereby allowing a user to roll his or her case along the ground while grasping the horizontally disposed extended handle.

Although these type of travel cases are convenient, the placement of the horizontally disposed handle is not the most convenient or comfortable way for the users hand to pull the travel case.

Currently, the users hand must be twisted ninety degrees from its normal orientation in order to grasp the existing horizontal pull handle. This twisted position can be fatiguing after a short period. Additionally, the pull out handles on many travel cases do not pull out far enough for the users foot, particularly a tall user, not to trip over the case as he or she is walking.

SUMMARY OF THE INVENTION

The primary object of the invention is to provide a travel case handle that can be easily attached to the existing travel cases having pull out handles, Another object of the invention is to provide a travel case handle that can swivel to a variety of positions to facilitate handle pulling.

Another object of the present invention is to provide a travel case handle that is ergonomically correct for the pulling application.

Other objects and advantages of the present invention will become apparent from the following descriptions, taken in connection with the accompanying drawings, wherein, by way of illustration and example, an embodiment of the present invention is disclosed.

Travel case pull handle comprisng: a pair of C shaped tubular members connected on one longitudinal side by a hinge member, a centrally located bearing capable of retaining an L shaped arm, said arm terminating in a ball joint, said ball joint fitted into a ball socket, said ball socket connected to a handle, said handle being ergonomically shaped to fit a users gripped hand and having a downwardly extending portion which cradles the users fore finger and thumb, said C shaped tubular members having hook type fastener material on one outer surface and a pair of fabric loop fastener strips extending from said opposite C shaped tubular member, and the inside of said C shaped tubular members each having resilient compressable, longitudinally running strips.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
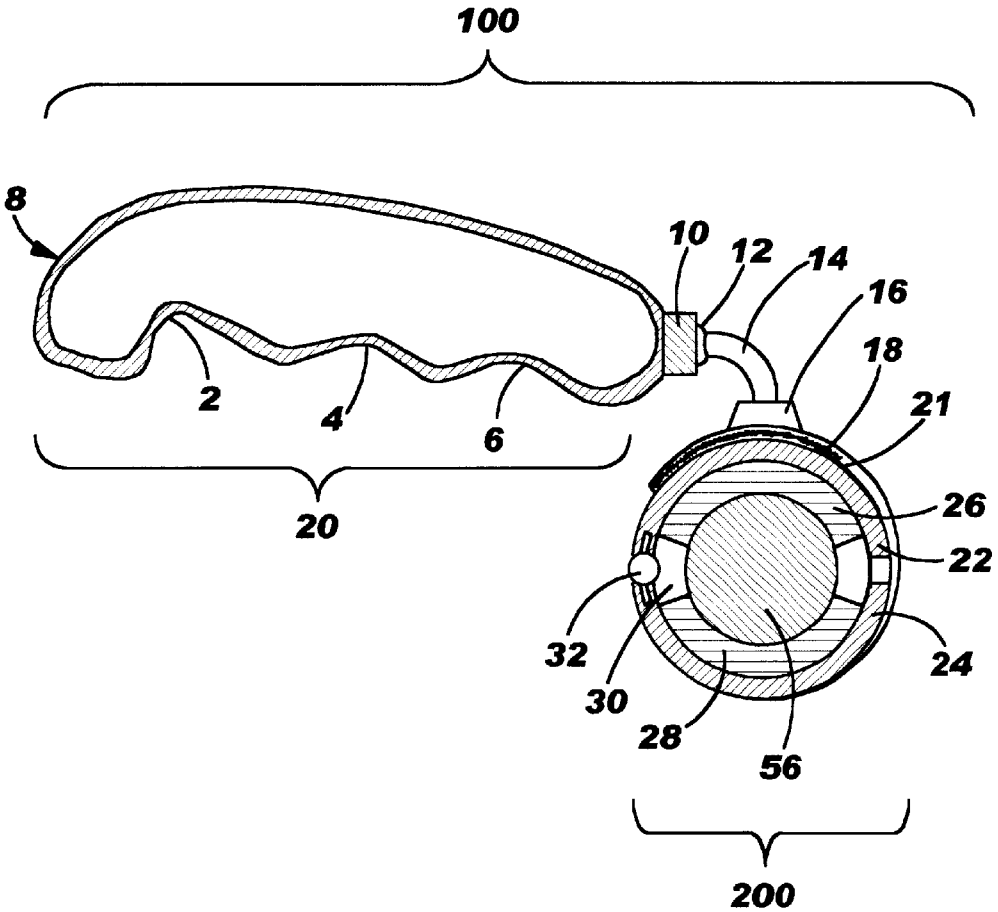
FIG. 1 is a side section view of the travel handle of the present invention.
Figure 2:
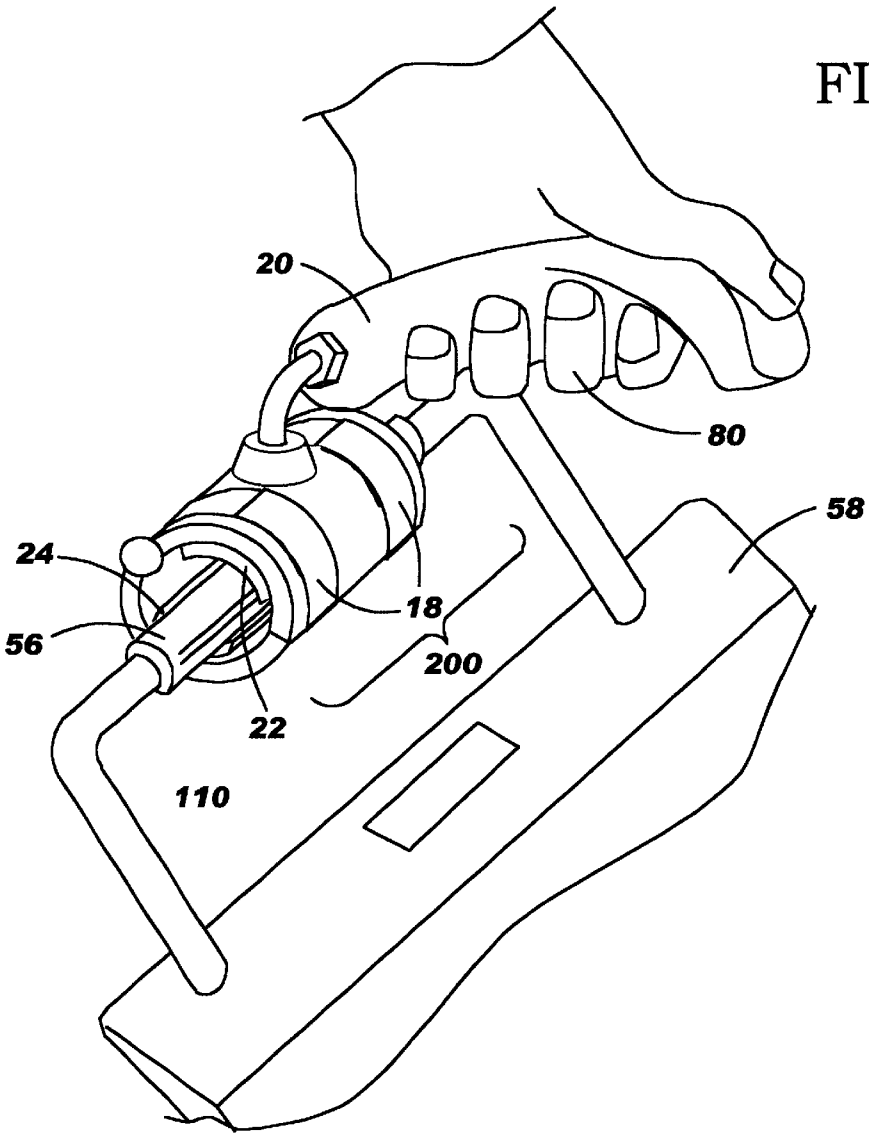
FIG. 2 is a perspective view of a person holding the travel handle of the present invention.
Figure 3:
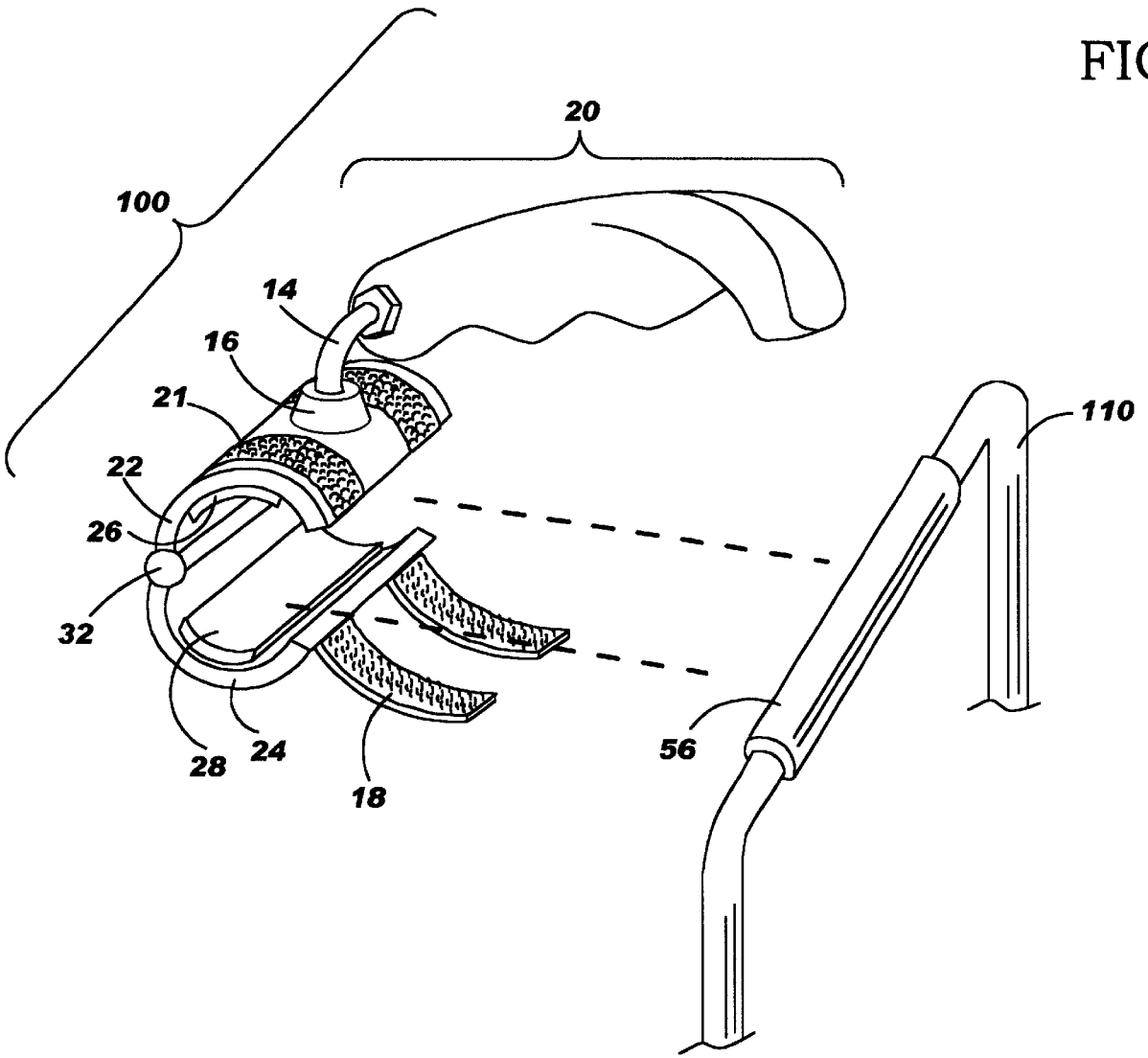
FIG. 3 is a perspective view of the travel handle of the present invention about to be attached to a handle of a typical rolling travel case.
Figure 4:
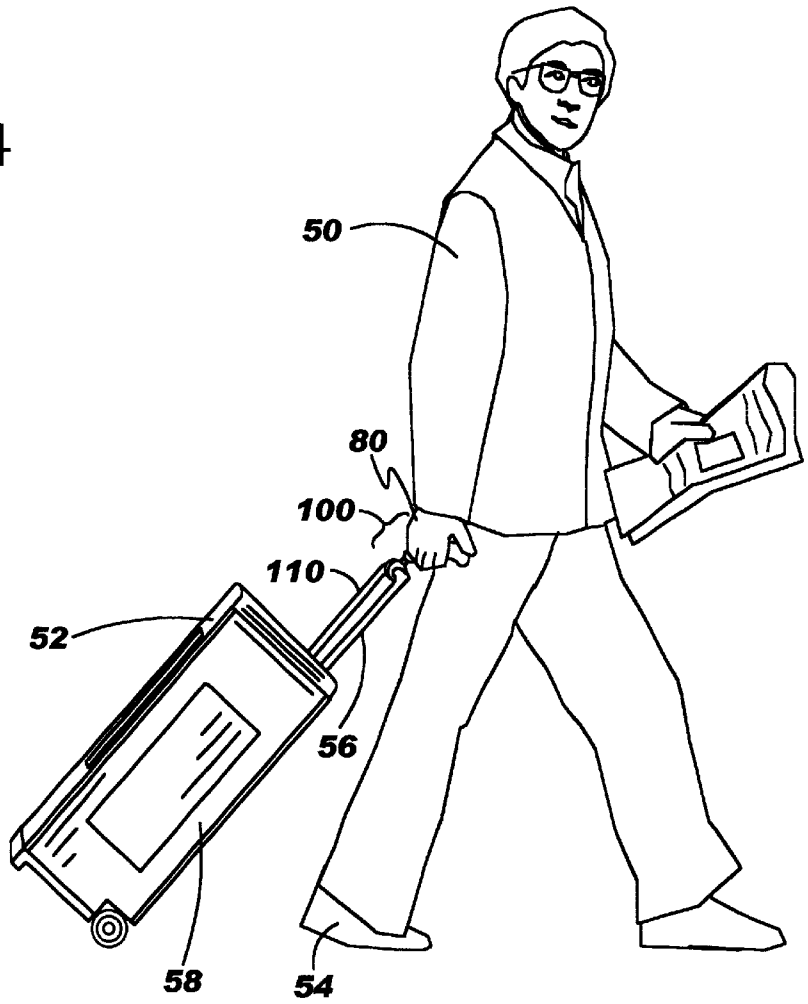
FIG. 4 is a perspective view of a person rolling a travel case using the handle of the present invention.

Referring now to FIG. 1 we see a side section view of the travel handle of the present invention 100, It is comprised of a case handle attachment means 200 and an ergonomically shaped pull handle 20, handle attachment 200 is comprised of a pair of opposed C shaped tubular members 22, 24 that are connected along one longitudinal surface by a hinge 32, The two C shaped members can open wide enough to allow a handle from a typical horizontal pull bar 56 as found on a typical rolling travel case to fit into the space 30. Resilient pads 26, 28 allow pull handles of different diameters to be firmly gripped by C shaped members 22, 24. Hook type VELCRO fastening material 20 is attached to the outer surface of C shaped member 22. A plurality of loop type VELCRO strips extend from the open edge of C shaped member 24 and can wrap around to fasten to the hook type VELCRO 20 thereby securing the horizontal pull bar 56 within space 30. Bearing 16 is fixed in the top center surface of C shaped member 22. One and of L shaped member 14 is fixed in the center of bearing 16 to allow it to swivel. The opposite end of L shaped member 14 terminates in a ball joint 12 that fits snugly into ball socket 10 thereby allowing attached handle 20 to be able to rotate plus or minus 20 degrees to give further flexibility to the possible positions of handle 20. The shape of handle 20 is designed to allow a users hand to fit snugly around it. Depressions 4, 6 allow for a comfortable finger grip return section formed by thumb rest 8 and fore finger rest 2 is shaped so that a user can pull a travel case with relative ease because the hook shape formed by walls 8 and 2 act as a resistive force against the users fore finger so that no extra effort is required in pulling the handle 20. This configuration can be seen more clearly in FIG. 2 where the users fingers 80 are gripped securely on to handle 20. Also shown in FIG. 2 are VELCRO strips 18, travel handle 56, handle arms 110 and a portion of travel case 58. FIG. 3 shows a clearer view of the present invention 100 as it is about to be attached to travel case handle 56. C shaped members 22, 24 are in the open position. VELCRO strips 18 are in the extended position and will wrap tightly around C shaped member 22 and attach to VELCRO strips 20. FIG. 4 shows a person 50 using the travel handle 100 of the present invention while attached to a typical rolling travel case having wheels 57 and a pull handle. Notice that the users hand 80 is in a normal position with respect to his body, If the present invention was not employed, the users hand would be twisted ninety degrees from its shown position thereby causing unnecessary fatigue and possible muscle strain. Additionally, the addition of handle 100 provides an important extension which makes it more difficult for the users foot 54 to accidentally bump into travel case 58 which can cause destabilization of travel case 58. The ability of the handle 20 of the present invention to rotate and swivel on all axis means that no matter what the users orientation to the handle 20 and the travel cases 58 orientation to handle 20, the handle 20 will always be in the ideal position so that the users hand 80 is in its natural position thereby reducing muscle fatigue in the hand and fore arm.

Obviously, the present invention could be integrally incorporated into the design of a travel case having an extendable handle so that the need for an add on handle as described in the invention would not be required.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A travel case pull handle comprising:

a pair of C shaped tubular members connected on one longitudinal side by a hinge member;

a centrally located bearing capable of retaining an L shaped arm;

said arm terminating in a ball joint;

said ball joint fitted into a ball socket;

said ball socket connected to a handle;

said handle being ergonomically shaped to fit a user's gripped hand and having a downwardly extending portion which cradles the user's fore finger and thumb;

said C shaped tubular members having hook type fastener material on one outer surface and a pair of fabric loop fastener strips extending from said opposite C shaped tubular member; and the inside of said C shaped tubular members each having resilient compressible, longitudinally running strips.

2. A travel case pull handle comprising: p1 a pull handle attachment means for removably attaching a handle to a rolling travel case handle, wherein the rolling travel case handle is oriented substantially parallel to a ground surface;

said attachment means comprising a pair of C shaped tubular members connected on one longitudinal side by a hinge member;

a centrally located bearing capable of retaining an L shaped arm;

said arm terminating in a connecting joint providing substantially universal rotation;

said connecting joint connected to a handle;

said handle having a downwardly extending portion for being grasped by a user's hand;

said C shaped tubular members being releasably connectable by hook type fastener material on one outer surface and a pair of fabric loop fastener strips extending from said opposite C shaped tubular member; and the inside of said C shaped tubular members each having resilient compressible, longitudinally running strips.

3. The travel case pull handle according to claim 2, wherein the connecting joint is a ball-and-socket joint.

4. The travel case pull handle according to claim 2, wherein the handle is ergonomically shaped to fit a user's gripped hand.

5. The travel sase pull handle according to claim 2, wherein the downwardly extending portion of the handle cradles the user's fore finger and thumb when grasped by the user.

6. A pull handle device for a rolling travel case comprising: p1 a pull handle attachment means for removably attaching a handle to a rolling travel case handle, wherein the rolling travel case handle is oriented substantially parallel to a ground surface;

said attachment means comprising a pair of C shaped tubular members connected on one longitudinal side by a hinge member;

a centrally located bearing capable of retaining an L shaped arm;

said arm terminating in a connecting joint providing substantially universal rotation;

said connecting joint connected to a handle;

said handle having a downwardly extending portion for being grasped by a user's hand;

said C shaped tubular members being releasably connectable by hook type fastener material on one outer surface and a pair of fabric loop fastener strips extending from said opposite C shaped tubular member; and the inside of said C shaped tubular members each having resilient compressible, longitudinally running strips.

7. The pull handle device according to claim 6, wherein the connecting joint is a ball-and-socket joint.

8. The pull handle device according to claim 6, wherein the handle is ergonomically shaped to fit a user's gripped hand.

9. The pull handle device according to claim 6, wherein the downwardly extending portion of the handle cradles the user's fore finger and thumb when grasped by the user.

* * * * *